United States Patent [19]

Mohaupt

[11] Patent Number: 4,673,039

[45] Date of Patent: Jun. 16, 1987

[54] WELL COMPLETION TECHNIQUE

[76] Inventor: Henry H. Mohaupt, 1151 Estrella Dr., Santa Barbara, Calif. 93110

[21] Appl. No.: 822,207

[22] Filed: Jan. 24, 1986

[51] Int. Cl.[4] ..... E21B 43/263

[52] U.S. Cl. ..... 166/281; 166/299; 166/63

[58] Field of Search ..... 166/63, 296, 299, 281, 166/305.1, 308

[56] References Cited

U.S. PATENT DOCUMENTS

| | | | |
|---|---|---|---|
| 994,866 | 6/1911 | Muhleisen | 175/329 |
| 1,854,477 | 4/1932 | McKissick | 166/317 |
| 2,201,290 | 5/1940 | Greene | 166/317 |
| 2,708,000 | 5/1955 | Zandmer | 166/100 |
| 2,725,942 | 12/1955 | McCullough | 166/376 |
| 2,913,051 | 11/1959 | Lister . | |
| 3,057,405 | 10/1962 | Mallinger | 166/100 |
| 3,095,040 | 6/1963 | Bramlett | 166/317 |
| 3,120,268 | 2/1964 | Caldwell | 166/376 |
| 3,216,497 | 11/1965 | Howard et al. | 166/376 |
| 3,242,987 | 3/1966 | Lebourg | 166/299 |
| 3,273,641 | 10/1966 | Bourne | 166/296 |
| 3,322,199 | 5/1967 | Van Note, Jr. | 166/205 |
| 3,333,635 | 8/1967 | Crawford | 166/296 |
| 3,360,047 | 12/1967 | Burnett . | |
| 3,422,760 | 1/1969 | Mohaupt . | |
| 3,434,537 | 3/1969 | Zandmer | 166/296 |
| 3,557,874 | 1/1971 | Rhodes et al. | 166/281 |
| 4,064,935 | 12/1977 | Mohaupt | 166/63 |
| 4,081,031 | 3/1978 | Mohaupt | 166/299 |
| 4,157,732 | 6/1979 | Fonner | 166/65.1 |
| 4,498,543 | 2/1985 | Pye et al. | 166/376 |
| 4,530,396 | 7/1985 | Mohaupt | 166/63 |

*Primary Examiner*—Stephen J. Novosad
*Assistant Examiner*—William P. Neuder
*Attorney, Agent, or Firm*—G. Turner Moller

[57] ABSTRACT

An oil or gas well is completed by cementing a casing string in a well having a special joint providing incipient perforations therein. The incipient perforations are closed during the cementing of the casing string in the well bore and are opened after the cement sets up. Preferably, the incipient perforations are opened concurrently with the fracturing of the cement sheath and the formation from which production is desired. The perforations of this invention are quite large and bear a ratio with the quantity of propellant in which there is at least 14 square inches of casing openings per cubic foot of propellant.

20 Claims, 8 Drawing Figures

WELL COMPLETION TECHNIQUE

This invention relates to the completion of wells, usually oil or gas wells, so that they will produce formation fluids into a conduit, known as a casing string extending from the subterranean formation to the surface of the earth.

The conventional technique for completing oil or gas wells through a bore hole extending through the productive formation is to lower a casing string through the zone and cement the casing string in place by pumping cement downwardly through the casing string so that it exits from the bottom of the casing string and passes upwardly through the annulus to cover the productive formation. Later, the casing string and cement are perforated. The original perforating technique fired a bullet through the casing string and cement sheath into the productive formation. A substantial improvement in the perforating process was introduced in the late 1940's by the use of high explosive driven metallic jets or so-called shaped charges. Jet perforators are a substantial improvement over the earlier bullet type perforators because they produce substantially less junk left in the hole and because the depth of penetration of shaped charges is always open to question, i.e. the depth of penetration is often much less than anticipated.

One of the pecularities of jet perforators is they produce relatively small diameter holes, typically 0.2–0.3 inches in diameter. Although these small diameter holes are easy to plug off by the use of ball sealers or the like when acidizing or fracing a well, the inability to generate perforations of more substantial diameter is a significant disadvantage in a number of very common situtations. For example, since small perforations are easy to plug off intentionally, they are also extremely easy to plug off unintentionally by the collection of fines, scale or the like. The opposite problem also occurs. Where production rates are very high, the flow rate through small perforations can be so great as to produce large quantities of sand into the well bore with its attendant problems. In addition, the use of very small perforations present an obstacle to formation stimulation by such methods as the generation and delivery of high pressure gas into the formation.

The effect of the size of perforations on the specific productivity index of a well completion has been the subject of numerous studies and investigations. For example, according to SPE Paper 3590, 1971, it was determined that the standard perforations of four holes per foot of about 0.5 inch diameter for an aggregate of 0.785 square inches per foot is substantially below optimum. Theoretically, perforations should not constitute a choke or restriction on the productivity of a well. This article suggests that about 8 square inches of perforations per linear foot of formation perforated is necessary to approach the specific porductivity index of the formation. This is about ten times the area of conventional perforations. Because the size of the perforations could not easily be increased, the only way to achieve ten times more perforated area was to perforate the section a multiplicity of times. At the time this article was written, the only way to achieve forty holes per foot was to shoot the well ten times with a conventional four shot per foot gun. Although perforating guns of higher shot density are available today, they are not commonly used.

It is known, of course, to mechanically or hydraulically cut notches, windows, vertical slots or the like in a casing string for a variety of different reasons. Even though these techniques produce much larger passages through the casing string, they have not normally been employed as a substitute for perforations. It will be appreciated, of course, that for such techniques to be a substitute for perforations, the cut made must be through the metallic casing string and the surrounding cement sheath into the formation in order to be effective.

The disclosure of oil well completion techniques in which holes larger than conventional shaped charge perforations are provided as found in U.S. Pat. Nos. 2,708,000; 2,725,942; 2,913,051; 3,057,405; 3,120,268; 3,216,497; 3,273,641; 3,322,199; 3,333,635; 4,157,732; and 4,498,543. Some of these techniques conceivably can be used in the practice of this invention, such as that found in U.S. Pat. No. 2,725,942. Also of interest are the disclosures in U.S. Pat. Nos. 994,866; 1,854,477; 2,201,290; 3,095,040 and 3,360,047.

The desirability of creating near open hole conditions to enhance producing efficiency is understood but is in conflict with the generally accepted standards governing casing perforation density in connection with well stimulating techniques such as hydraulic fracturing, acidizing and the like. The controls so essential in acidizing and hydraulic fracturing are best achieved with limited entry into the formation, such as only one or two $\frac{3}{8}''$ diameter casing perforations per ten foot zone or at most four standard perforations per linear foot of formation. The emphasis on standard diameter perforations is important since the surface pump horsepower requirements and flow rates are determined by the known carrying capacity of small perforations of known size. In addition, the technique of ball sealing is used extensively in acidizing and hydraulic fracturing in an effort to divert the stimulation treatment through judiciously spaces successive perforations of small diameter.

The conflicting desiderata of large area casing openings for well productivity and small perforations for stimulation control have been reconciled by this invention in which high pressure gaseous combustion products are liberated inside the well casing adjacent large area casing openings to produce fractures in the productive formation. The fracturing process of this invention may also be used to create the large area openings in the casing string contemporaneously with fracturing of the formation.

In order to insure the benefits derived from this system, it is important to achieve a match between the total well casing perforation area and the gas generated during the process. It has been found in well tests that a gas generating solid propellant tool releasing on the order of 70 standard cubic feet of gas per linear foot in ten milliseconds can best be accommodated by eight $\frac{3}{4}$ inch diameter casing perforations per linear foot or a total of $3\frac{1}{2}$ square inches of perforation per linear foot. A material reduction in this ratio can be tolerated only at the expense of increased lift in the liquid column used to constrain the gaseous combustion products in the well, reduced fracture propagation and overall efficiency and possible casing damage.

Tests have been conducted in actual wells to determine the practical limits of this relationship. Wells ranging in depth from a few hundred feet to over 14,000' with casing sizes ranging from $3\frac{1}{3}''$ to 7" nominal diameter were stimulated with gas generating techniques under varying hydrostatic heads. Pressure measurement, casing caliper logs and production results indicate that the lower safe limit for casing perforation density is on the order of about 14 square inches of perforation per cubic foot of solid propellant which combusts to produce to about 800 standard cubic feet of gaseous combustion products.

In summary, this invention comprises a substitute for conventional jet or bullet perforating of a well after the casing string has been cemented in place. In the technique of this invention, the casing string that is run into the hole adjacent the productive formation is configured to provide sensible incipient perforations. The term incipient perforation in intended to mean an area of the casing string which will ultimately become a flow path through the casing string but which is presently blocked off to prevent fluid flow across the wall of the casing string. The phrase sensible or detectable by human senses is intended to mean that the location of the incipient perforations can be found by seeing or touching at a time before the casing string is run into the well. Merely because the incipient perforations are detectible by human senses is not intended to mean that they are undetectable by more advanced technological techniques or methods.

In the technique of this invention, the casing string having incipient perforations thereon are run into the hole so that the incipient perforations are located adjacent the productive formation. The well is then cemented by more-or-less conventional means, as by pumping cement downwardly through the casing string so that it passes through the bottom of the casing string and flows upwardly in the annulus between the casing string and the productive formation to provide a cement sheath therearound. After the cement has set up, the incipient perforations are opened so that the cement sheath is open to the interior of the casing string. Because of the size of the perforations, when opened, can be very large, there is little or no flow restriction between the formation and the interior of the casing string except for the cement sheath. In one group of embodiments of this invention, flow passages are next created between the interior of the casing string and the formation followed by fracturing of the cement sheath and productive formation by the release of large quantities of high pressure gaseous combustion products. In some embodiments, the release of the high pressure gaseous combustion products acts to create the flow passages through the casing wall as well as fracture the annular cement sheath and the productive formation.

There are numerous geological and seismic conditions that preclude advance determination of the existence of hydrocarbon bearing formations in a well. It is even more difficult to predict the exact depth, thickness and productivity of any hydrocarbon producing formation. Most development wells are targeted for a specific formation which may be produced for years until depleted. An attempt to recomplete such a well in another zone may thus be delayed for years and will require casing perforation in a conventional manner. The economic realities, coupled with technical restrictions, limit the effective openings that can be achieved by such conventional methods. In order to enhance communication with the reservoir, the subsequent perforating should be combined with the gas stimulation technique, applying the minimum rule of 14 square inches of aggregate open perforations per cubic foot of solid propellant.

The gas pressure applied to break down the perforations if the perforations are preformed, or to create the performations if contemporaneously formed, and to extend multiple fractures into the formation should be substantially below the yield point of the casing string. In wells of medium depth, this pressure level may be in the range of 5,000–12,000 psi. In deep wells, depending on the overburden and whether the zones are overpressured, the peak pressures may reach the 20,000 psi range. It is important that the use of explosives be excluded from this process because the pressure spikes generated thereby exceed several hundred thousand psi and are potentially damaging to the casing and also tend to locally compact the surrounding formation thus decreasing its permeability in localized zones thereby partially defeating the attempt at increased productivity.

It is accordingly an object of this invention to provide an improved well completion technique.

Another object of this invention is to provide an improved well completion technique providing perforations between the interior of the casing string and a productive formation which are substantially larger than can be obtained by conventional jet or bullet perforations.

Other objects and advantages of this invention will become more fully apparent as this description proceeds, reference being made to the accompanying drawings and appended claims.

IN THE DRAWINGS

Figure 1:
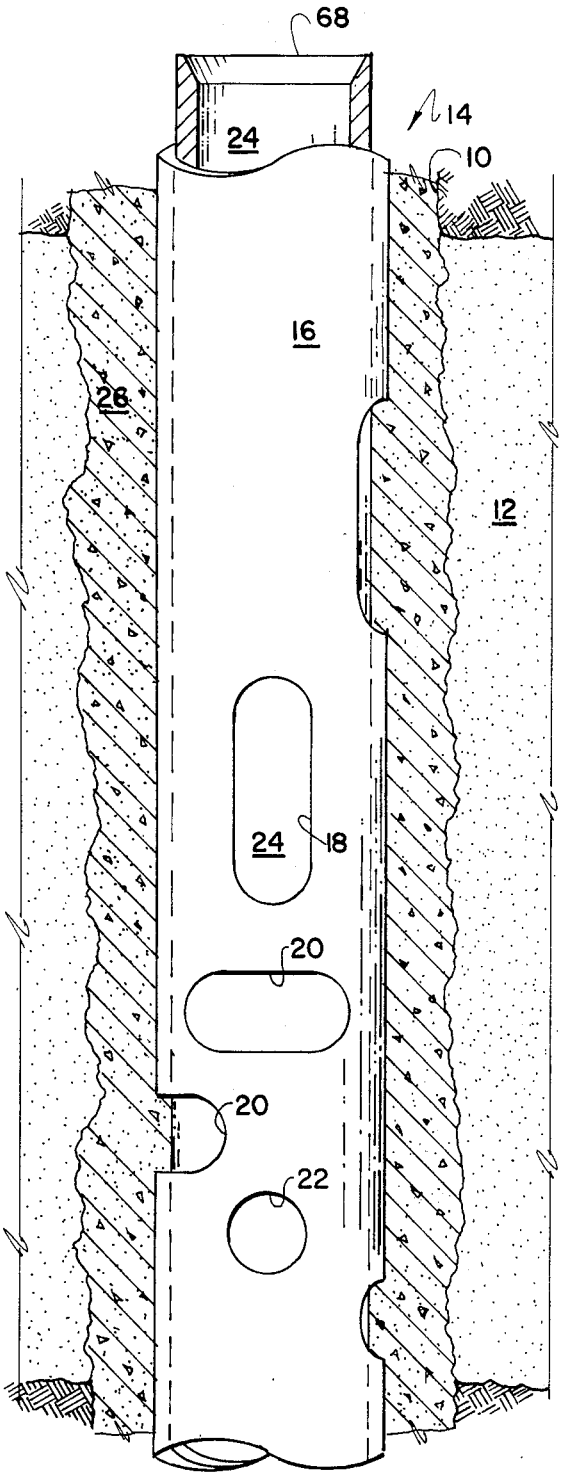
FIG. 1 is an enlarged, partially cross-sectional view of a casing string having incipient perforations therein cemented in a well bore adjacent a productive formation.
Figure 2:
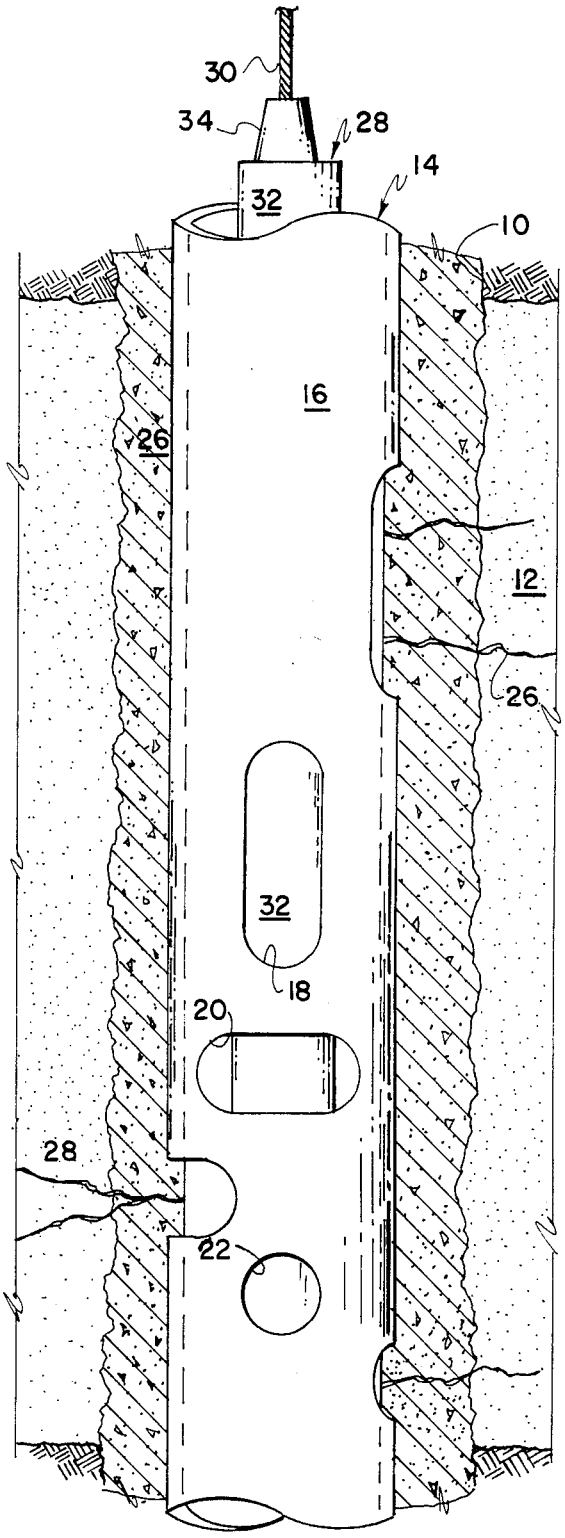
FIG. 2 is a view similar to FIG. 1 illustrating that the perforations have been opened and fractures generated to communicate the productive formation with the interior of the casing string.

Referring to FIGS. 1 and 2, there is illustrated one embodiment of this invention. A bore hole 10 has been drilled into the earth sufficiently deep to penetrate a productive subterranean formation 12. A casing string 14 comprising a multiplicity of generally uniform joints (not shown) and a special joint or joints 16 are lowered into the well bore 10 until the special joint or joints 16 are immediately adjacent the productive formation 12.

As understood by those skilled in the art, the uniform joints of the casing string 14 generally comprise a tube of cylindrical cross-section having male threads on both ends thereof. A collar having female threads at both ends is threaded onto one end of the tube to provide a joint of casing.

The special joint 16 includes at least one and preferably a multiplicity of rather large openings which may be configured as vertical slots 18, horizontal slots 20 or round openings 22. Latched inside the special joint 16 is a removable imperforate sleeve 24 which closes off the openings thereby making them incipient perforations.

After the special joint or joints 16 have been lowered into the bore hole 10 to adjacent the formation 12, cement 26 is pumped downwardly through the casing string 14 and the sleeve 24 so that it exits from the bottom of the casing string 14 and flows upwardly in the annulus between the casing string 14 and the well bore 10. In time, the cement 26 sets up to bond the casing string 14 to the wall of the bore hole 10 as will be appreciated by those skilled in the art.

The sleeve is then removed from the interior of the casing string 14 in any suitable fashion. One suitable technique is to unlatch the sleeve 24 with a wire line tool (not shown) and withdraw the sleeve 24 upwardly to the surface through the casing string 14. In the alternative, the sleeve 24 may be drilled up with a bit or mill or dissolved by making the sleeve 24 of acid soluable material. In any event, the sleeve 24 is removed to leave the situation as shown generally in FIG. 2.

In order to provide communication between the interior of the casing string 14 and the productive formation 12, a multiplicity of flow paths 26 are created by the use of a gas fracturing technique. In this technique, a gas fracturing tool 28 is lowered into the well inside the casing string 14 on a wire line 30. The tool 28 comprises a solid propellant charge 32 and an igniter 34 which is energized by an electrical signal passing downwardly through the wire line 30 to ignite the charge 32 to thereby produce a large quantity of high pressure gaseous combustion products, as shown in U.S. Pats. Nos. 3,422,760; 4,064,935; 4,081,031 and 4,530,396, the disclosures of which are incorporated herein by reference. As mentioned previously, the ratio between the size of the open passages 18, 20, 22 aggregates at least 14 square inches per cubic foot of propellant.

The provision of the large openings 18, 20, 22 are particularly advantageous when fracturing the productive formation 10 with high pressure gaseous combustion products because the size of the openings 18, 20, 22 do not restrict flow of the gaseous combustion products into the formation, thereby enhancing the size, length and lateral extent of the fractures 26. Because the fractures 26 will be of greater size, it will be seen that, all other things being equal, the rate of flow of formation fluids into the casing string 14 will be greater and the pressure drop across the formation will be less.

Figure 3:
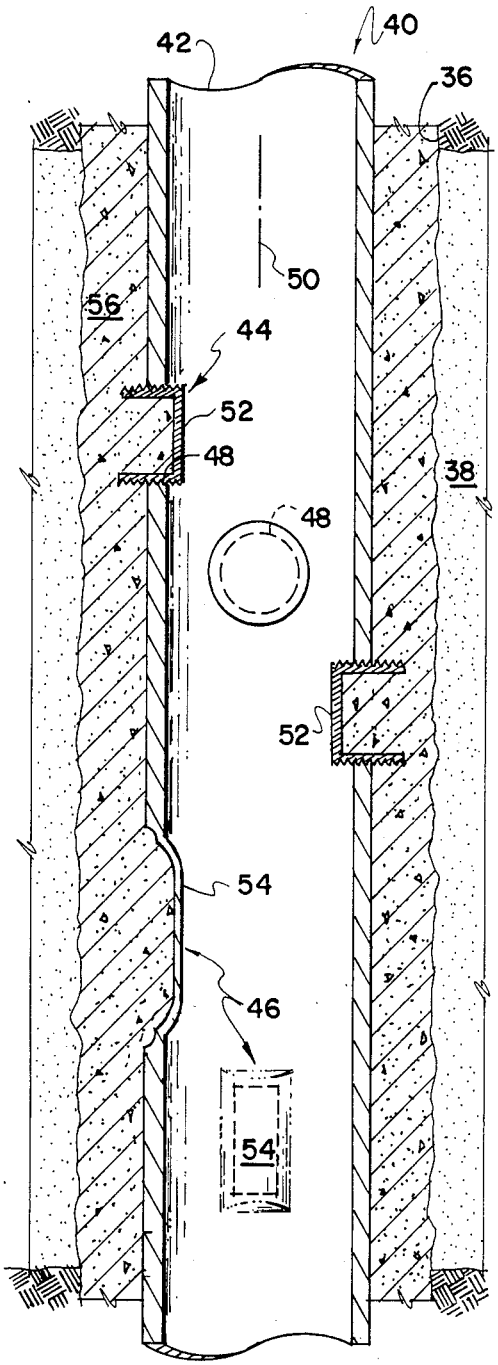
FIG. 3 is an enlarged cross-sectional view of a casing string having incipient perforations therein of two different types, the casing string being cemented in a well bore adjacent a productive formation.
Figure 4:
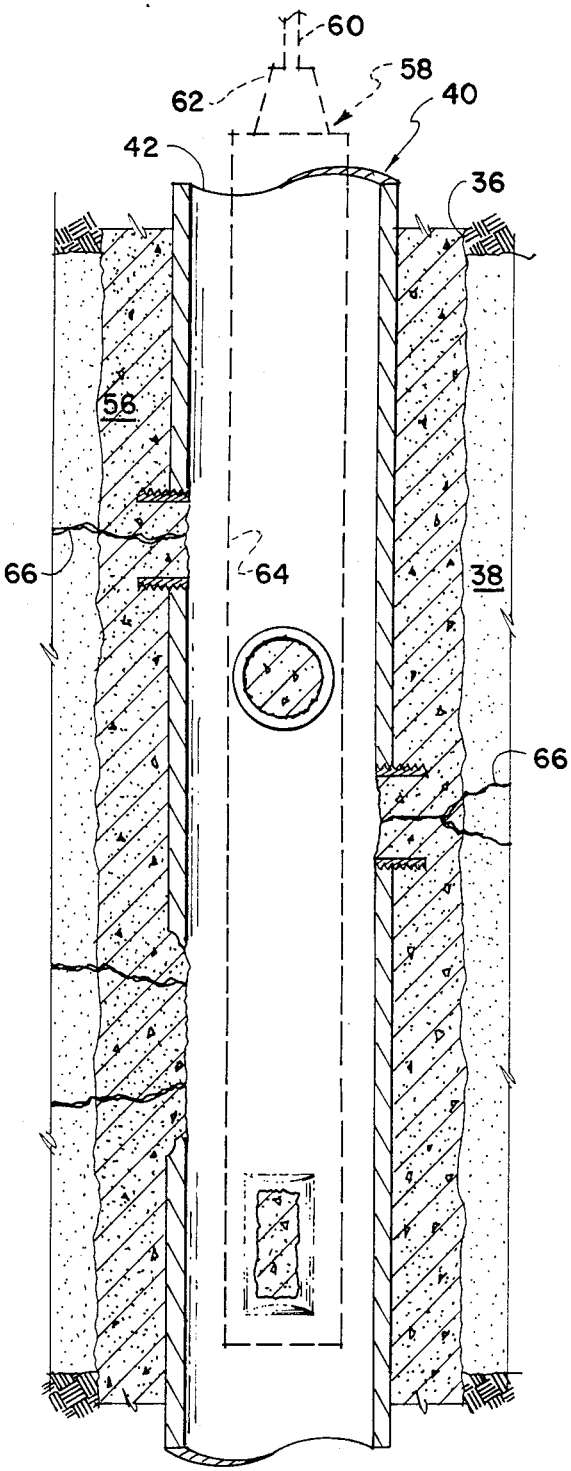
FIG. 4 is a view similar to FIG. 3 showing that the incipient perforations have been opened and fractures created to communicate the productive formation with the interior of the casing string.

Referring to FIGS. 3 and 4, another embodiment of this invention is illustrated. A bore hole 36 has been drilled into the earth sufficiently deep to penetrate a productive formation 38. A casing string 40 comprising a multiplicity of generally uniform joints (not shown) and a special joint or joint 42 are lowered into the well bore 36 until the special joint or joints 42 are immediately adjacent the productive formation 38.

The special joint 42 includes at least one and preferably a multiplicity of large incipient perforations 44, 46 which are illustrated as of two different types. The incipient perforations 44 each include a threaded opening 48 in the wall of the joint 42 which is transverse to the longitudinal axis 50 of the casing string 40. Closing each of the threaded openings 48 is a threaded plug 52 extending into the interior of the joint 42.

The incipient perforations 46 comprise elongate vertically extending dimples or protuberances 54 projecting into the interior of the casing string 40. The dimples 54 may be formed by placing the joint 42 in a press and deforming the wall of the joint with a die of any suitable configuration.

After the special joint or joints 42 have been lowered into the well bore 36 to adjacent the formation 38, cement 56 is pumped downwardly through the casing string 40 so that it exits from the bottom of the string 40 and flows upwardly in the annulus between the string 40 and the well bore 42. In time, the cement 56 sets up to bond the casing string 40 to the wall of the well bore 30 as will be understood by those skilled in the art.

The plugs 52 of the incipient perforations 44 and the protuberances 54 of the incipient perforations 46 are then removed in any convenient manner. They may easily be drilled up with a bit or mill. In the case of the plugs 52, the plugs 52 may be made of aluminum or other acid soluble material so they can be removed by simple acid treatment. Preferably, the plugs 52 and/or the protuberances 54 are shattered or disintegrated by the same gas fracturing tool used to create fractures in the cement sheath 56 and in the formation 38.

To this end a gas fracturing tool 58 is lowered, by a wire line 60, inside the casing string 40 to a location adjacent the formation 38. A quantity or cushion of salt water, fresh water, lease crude or other hydrocarbons is placed inside the casing string 40 on top of the tool 58, usually extending 1000′ or so above the top of the tool 58. An electrical signal is passed down the wire line 60 to energize an igniter 62 thereby igniting a solid propellant charge 64. Combustion of the charge 64 creates a large quantity of high pressure gaseous combustion products which shatters or ruptures the plug 52 and/or the dimple 54. The same high pressure gas fractures the cement sheath 56 thereby creating the flow paths 66 through the cement sheath 56 into the formation 38. The same high pressure gas fractures the formation 38 to increase its productivity. As with the embodiment of FIGS. 1 and 2, the openings formed in the casing string 40 comprise at least 14 square inches of perforation per cubic foot of the solid propellant charge 64.

As will be appreciated by those skilled in the art, the embodiments of FIGS. 1–4 present a cementing problem because something is present inside the casing string 14, 40 which could, depending on its size or configuration, interfere with the downward passage of conventional cementing plugs through the casing string 14, 40. In the embodiments of FIGS. 1–4, the cementing technique is to pump a predetermined quantity of cement into the casing string 14, 40 and then follow it with a quantity of mud or water without interposing a cementing plug between the cement and the following liquid. It is preferred to provide a smooth surface on the inside of the special joints 16, 42 of the same size as a remainder of the casing string 14, 40 in order to allow reliable downward movement of a cementing plug through the special joint or joints required by this invention.

Conventional cementing plugs are capable of accommodating considerable variation in the internal diameter of the casing string. For example, 5½″ O.D. casing is available in five wall thicknesses so that the pipe varies from 14–23 pounds/foot and the internal diameters vary from 5.012–4.570". Since one size cementing plug is used for these differently sized I.D. casing strings, it will be evident that conventional cementing plus are capable of accommodating slightly different internal diameters. Thus, in the embodiment of FIGS. 1 and 2, the upper end 68 of the sleeve 24 is preferably tapered to allow the rubber seals of conventional cementing plugs to make the transition from the normal joint of the casing string 14 to the special joint 16. For example, assuming the normal casing string 14 is 5½ inch, 15.5 lb./ft., having a wall thickness of 0.275 inches and an internal diameter of 4.950 inches, the special joint 16 may have an internal diameter of 4.95 inches with the sleeve 24 having an outer diameter of 4.95 inches and a wall thickness of 0.125 inches so that the internal diameter of the sleeve 24 is 4.70 inches. Under these situations, a conventional 5½ inch cementing plug will pass through the casing string 14 as well as through the special joint 16. After the casing string 14 is cemented in the well, the sleeve 24 can be drilled up or dissolved as previously discussed.

Figure 5:
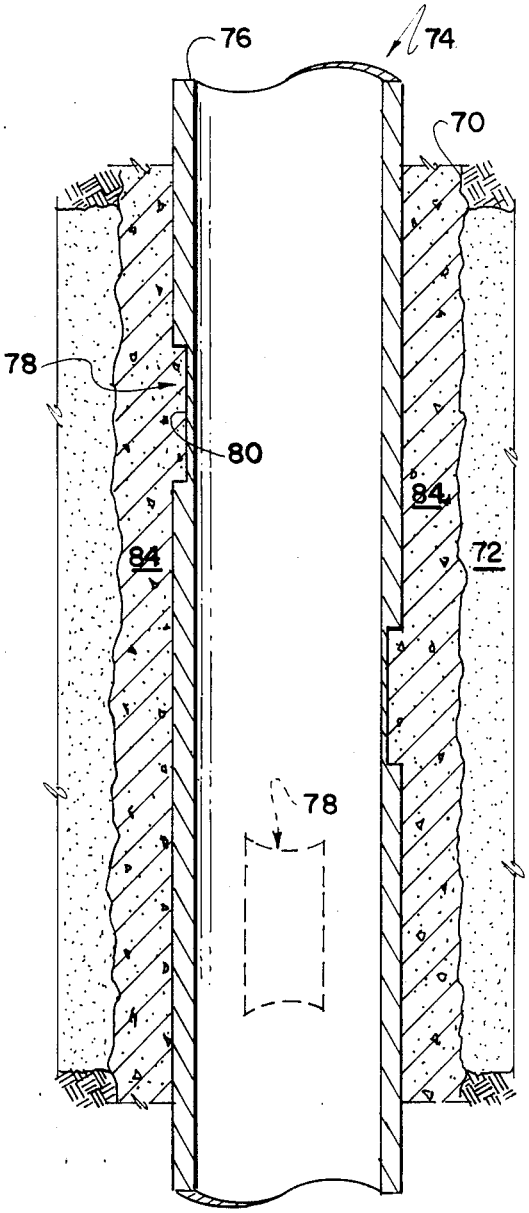
FIG. 5 is a view similar to FIGS. 1 and 3 illustrating another technique of providing incipient perforations.
Figure 6:
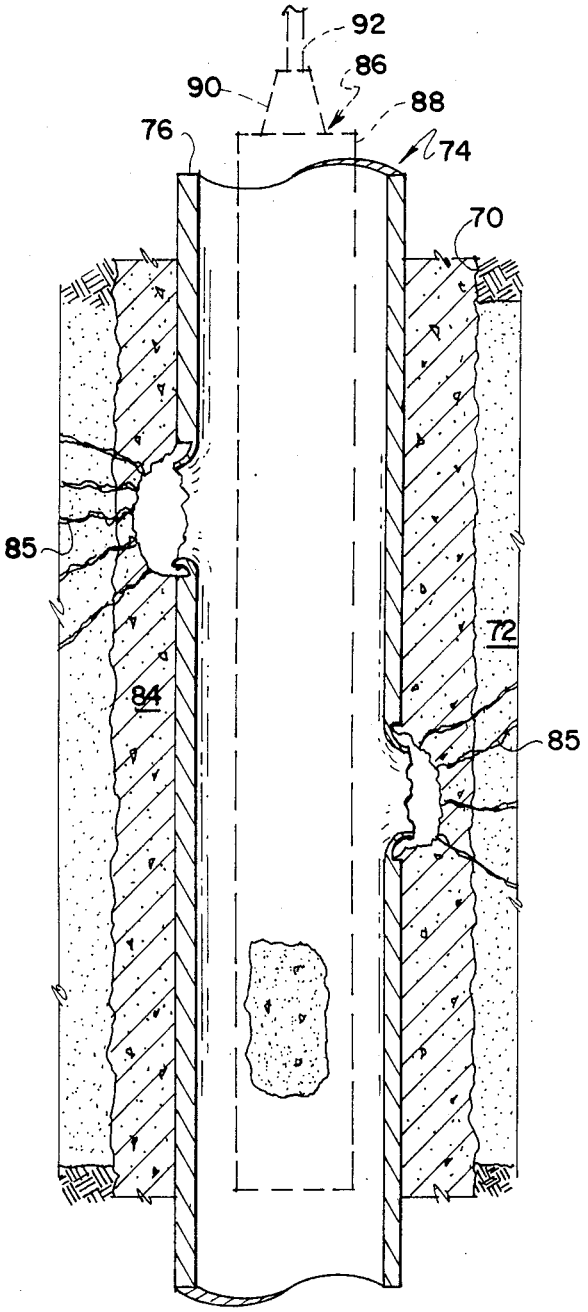
FIG. 6 is a view similar to FIG. 5 illustrating that the incipient perforations have been opened and fractures created to the productive formation.

It will be evident that it is preferred to provide a smooth surface on the inside of the special joints 16, 42 of the same size as the remainder of the casing string 14, 40 in order to allow reliable downward movement of a cementing plug through the special joint or joints required by this invention. To this end, the embodiment of FIGS. 5 and 6 is provided.

A bore hole 70 is drilled into the earth sufficiently deep to penetrate a productive subterranean formation 72. A casing string 74 comprising a multiplicity of generally uniform joints (not shown) and a special joint or joints 76 are lowered into the well bore 70 until adjacent the productive formation 72.

Figure 7:
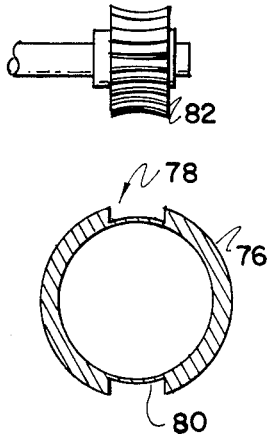
FIG. 7 is a pictorial view illustrating how the incipient perforations of FIG. 5 may be created.

The special joint 76 includes at least one and preferably a multiplicity of incipient perforations 78 comprising elongate vertically extending sections 80 of the joint wall which are of reduced wall thickness. The sections 80 are accordingly weaker in burst than the remainder of the casing string 74 or the special joint 76. As shown best in FIG. 7, the areas 80 can be easily machined on the joint 76 by using a concave milling cutter 82 to machine the areas 80 in any desirable pattern about the exterior of the special joint 76. Conveniently, the areas 80 are spaced at 90 degree intervals about the joint 76.

It will be evident to those skilled in the art that the special joint 76 is somewhat weaker in tension and in buckling than the remainder of the casing string 74. This can be accommodated to a large degree by selecting the joint 76 to have initially greater wall thickness than the remainder of the casing string 74. For example, a conventional type of 5½" casing weighs 15.5 pounds per foot and has a wall thickness of 0.275". When using a special joint 76 of this invention in such a casing string, one would select a joint of 5½", 18 lbs/ft having a wall thickness of 0.415". By machining the areas 80 into a joint of initially greater wall thickness, the resultant joint 76 will be of adequate mechanical strength for the purpose intended. It will be evident, of course, that the joint 76 need not be made from a conventional joint of casing and that it may be machined de novo from a piece of stock material having whatever mechanical strength or wall thickness desired.

After the special joint or joints have been lowered into the well bore 70 to adjacent the formation 72, cement 84 is pumped downwardly through the string 74 so that it exits from the bottom of the string 74 and flows upwardly in the annulus between the casing string 74 and the well bore 70. In time, the cement 84 sets up to bond the casing string 74 to the wall of the well bore 70 as will be understood. It will be seen that the interior wall of the special joint 76 is smooth and essentially the same size as the remainder of the casing string 74 so that there is little impediment to the passage of conventional cementing plugs.

The incipient perforations 78 are then opened by pressurizing the interior of the casing string 74. The incipient perforations 78 may be opened simply by pumping salt water, diesel or lease crude into the casing string 74. Preferably, the incipient perforations 78 are open concurrently with the creation of the fractures 85 providing communication between the interior of the casing string 74 and the formation 72. To this end, a gas fracturing tool 86 is run into the casing string 74 and covered by a quantity of salt water, completion fluid, lease crude or the like. The tool 86 includes a solid propellant charge 88 and an igniter 90 which is energized by an electrical signal passing down the wire line 92 to produce a quantity of high pressure gaseous combustion products inside the casing string 64 which bursts the thin walled sections 80 and creates the fractures 85 as shown best by a comparison of FIGS. 5–6. By selecting the size of the weakened areas 80 to be very large relative to the size of the propellant charge 88, the fracturing results of the gas generated by the tool 86 is promoted.

Figure 8:
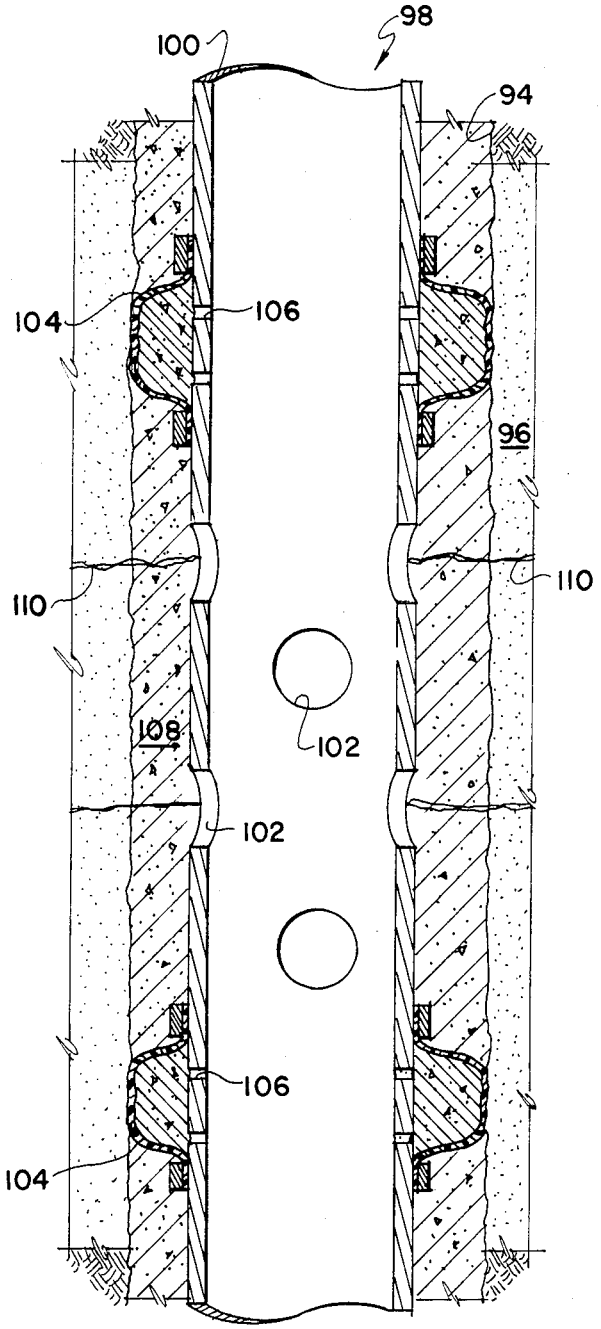
FIG. 8 is a view partially in cross-section illustrating another embodiment of this invention.

Another embodiment of this invention is illustrated in FIG. 8. A bore hole 94 is drilled into the earth to penetrate a productive formation 96. A casing string 98 comprised of a multiplicity of uniform joints (not shown) and one or more special joints 100 are run into the well bore 90 until the special joints 100 are adjacent the formation 96.

The special joints 100 includes one or more incipient perforations 102 which, in the illustration of FIG. 8, have already been opened by the use of any of the techniques heretofore described. On the outside of the special joint 100 are a pair of conventional inflatable packers 104 communicating with the interior of the casing string 98 by the provision of openings 106. As is conventional, the packers 104 inflate during the cementing process to prevent fluid migration up and down the well bore 90 to minimize gas cutting the cement 108. After the cement 108 is set up, the flow paths or fractures 110 are created by the technique heretofore described wherein a large quantity of high pressure gaseous combustion products are generated inside a casing string wherein there is at least 14 square inches of casing openings per cubic foot of solid propellant.

Aside from the desirability of a large perforation area, several other factors influence the selection and geometry of the incipient perforations of this invention. As alluded to previously, the physical strength of the casing string cannot be compromised to the point where deformation of the special casing joint may occur due to external pressure, internal pressure, tension, or buckling. Even with these limitations, the present invention permits the provision of large perforation areas per linear foot of casing. For example, with 5½" OD casing, which has a circumference of 17.279 inches, it is feasible to provide 18 square inches of perforations per linear foot by providing six slots per foot each measuring 1" wide×3" long. It will also be seen that other configurations will provide very large perforation areas per linear foot of pipe.

The importance of large perforation area is particularly acute when large quantities of high pressure gaseous combustion products are used to stimulate the formation. This process typically involves the combustion of a solid propellant charge of predetermined length, which can be greater or lesser than the thickness of the formation. The size and composition of the propellant charge can be adjusted to generate gas at a rate of ten thousand standard cubic feet per lienar foot per second. The very large perforated area allows transfer of this volume of gas into the formation with minimum pressure drop, a condition favorable for initiating and driving multiple fractures at high velocity and for a considerable distance into the formation.

Figure 9:
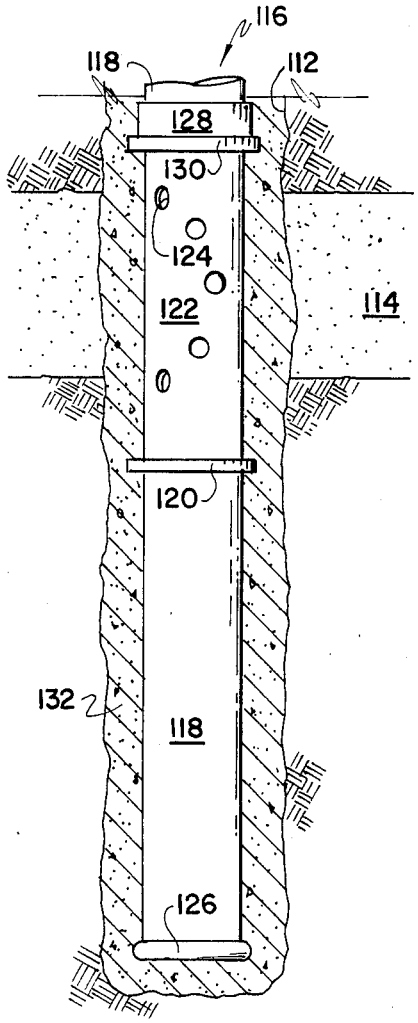
FIG. 9 is a view partially in cross-section illustrating another embodiment of this invention.

Another technique to accommodate this invention to conventional cementing practices is shown in FIG. 9 where a bore hole 112 has been drilled in the earth to penetrate a productive formation 114. A casing string 116 has been run into the bore hole 112 and comprises a plurality of uniform conventional joints 118 having a collar 120 on the top thereof a special joint 122 of this invention providing incipient perforations 124. On the bottom of the lowermost conventional joint 118 is a float shoe 126. In accordance with conventional practice, a float collar would be placed at the top of the lowermost joint 118. In the technique of FIG. 9, a float collar 128 is instead threaded into a collar 130 on top of the special joint 122. In this embodiment, the cementing plugs land in the float collar 128 while cement 132 is pumped downwardly through the casing string 116 and exits from the float shoe 126. At the end of cementing, the special joint 122 and the lowermost uniform joint 118 are filled with cement. In the process of completing the well, the float collar 128 and cement inside the special joint 122 are drilled up with a bit which also opens the incipient perforations 124. In this fashion, regardless of the particular technique used to provide the incipient perforations, it does not interfere with the passage of conventional cementing plugs used to cement the casing string in place.

The ratio of 14 square inches of casing openings per cubic foot of solid propellant implies either that the casing openings may be very large or that the amount of propellant may be very small. There is, however, an additional factor because the amount of propellant conceivably could be so small as to provide inadequate fracturing of the cement sheath as well as of the productive formation. In other words, this invention incorporates the use of a relatively large amount of propellant and very large casing openings as opposed to a relatively small amount of propellant and ordinary sized casing openings.

There are a variety of ways by which this may be articulated. Viewed from one perspective, the technique of this invention uses a quantity of propellant at least on the order of 25% of the internal capacity of the casing string per linear foot of open perforations. Taking, for example, a common situation where there are twenty feet of open perforations completed through $4\frac{1}{2}''$ casing having an internal diameter of 4.0 inches, the size of the propellant charge would be not less than: $0.25(3.1417\times4.0)\times1/144\times20=0.436$ cubic feet of propellant and have at least $0.436(14)=6.104$ square inches of open perforations. This may be compared to a common situation where a twenty foot producing interval has been conventionally jet perforated at 4 shots/foot to produce 0.25" diameter holes. This would amount to: $(3.1417\times0.125\times0.125)\times\mathbf{20}\times\mathbf{4}=\mathbf{3.927}$ square inches. Thus, the situation of this invention uses almost twice as much open casing perforations as is conventional.

When the amount of propellant increases, as a proportion of internal casing volume per linear foot of open perforations, the quantity of open casing perforations also increases and increases exponentially. For example, when using a quantity of propellant equal to 40% of the internal casing volume per linear foot of open perforations, the amount of open casing perforations must be well in excess of 14 square inches per cubic foot of propellant. Preliminary indications are that the ratio of open perforations in square inches per cubic foot of propellant should be on the order of 50. Using the above example of twenty feet of open perforations completed through $4\frac{1}{2}''$ O.D. casing having an I.D. of 4.0, the quantity of propellant is: $0.40(3.1417\times2\times2)\times1/144\times20'=0.698$ cubic feet of propellant. In this circumstance, there should be $0.698(50)=34.9$ square inches of open perforations in the twenty foot interval. It will accordingly be seen that this invention contemplates the use of very large perforations.

Stated differently, the gas generating tool should have the capability of delivering a minimum amount of energy into the cement sheath and formation surrounding the large casing openings afforded by this invention. It might be thought, for example, that conventional jet perforating consists of concurrently opening perforations in the casing, producing fractures or flow channels in the cement sheath as well as producing fractures in the productive formation. Whether this is an accurate description of what goes on during jet perforating is open to question. It will be evident, however, that the technique of this invention is substantially different for a variety of reasons, one of which is that this invention liberates a significantly greater amount of energy than do jet perforators, particularly when considered on a per linear foot of perforations to be opened. Shaped charges of the type used in conventional jet perforators use on the order of 1 gram/charge. Each gram of charge delivers about 2000 foot pounds of energy. Thus, a 4 shot/foot gun delivers about 8,000 foot pounds/foot of perforations while a theoretical very high density gun shooting 20 shots/foot would delivery about 40,000 foot pounds/foot of perforations. Propellants of the type used in this invention typically deliver on the order of 85,000,000 foot pounds/cubic foot of propellant. Thus, this invention involves delivering on the order of at least 1,000,000 foot pounds of energy per foot of perforations opened.

A few words need to be said about propellants. There are a very large number of compounds of compositions that are theoretically useable as propellants for any downhole gas generating type fracturing method. Many of these propellants are not particularly suitable because they are soluble in well bore fluids and have to be specially protected, are too difficult or to easy to ignite, or are too much trouble in one way or another. As a practical matter, any propellant which delivers at least on the order of about 400 standard cubic feet of gaseous combustion products per cubic foot of solid propellant will be quite suitable in the practice of this invention.

In a conventional situation, a well may be perforated with a perforating gun and then stimulated by acidizing or fracturing in a wholly separate and distinct operation at some later date. In a conventional situation there is no fixed time period between the perforating of a well and when the well might be stimulated. It is quite common practice to perforate a well, place it on production and later determine whether, and to what extent, the well needs to be stimulated.

In the technique of this invention in which a high pressure gas charge is generated in the casing, the flow channels corresponding to perforations are generated at the outset of a process which not only forms the flow paths across the cement sheath but which also creates fracture-like flow channels extending to a substantial depth into the formation. Typical perforating guns create a flow passage which extends from the interior of the casing string, through the cement sheath but only a short distance into the formation. In contrast, the practice of this invention concurrently produces flow channels corresponding to perforations but also produces fracture-like flow channels extending substantially into the formation.

This invention is also to be distinguished from tubing conveyed perforators where a number of perforating charges, which may be either a large number or a small number, are suspended from the bottom of the tubing string and lowered into the well bore below a packer. In this situation, the packer is set and the tubing is swabbed dry, or substantially so, before the perforating charges are detonated, usually by a go devil. Perforating techniques of this type are done in an effort to minimize damage to the formation by contacting the formation with well bore liquids. It is necessary to run a liquid cushion on top of the tools of this invention, or any other gas generating fracturing technique, because the liquid cushion acts to force the combustion products into the formation rather than allowing them to take the path of least resistance and flow harmlessly and fruitlessly up the hole.

Because of the discussion herein of the use of a special joint having incipient perforations therein, it may be thought that the use of such joints is necessary to the practice of this invention. While such joints may be preferable, there are many situations where this invention may be practiced without the use of such joints, such as where a well has been completed in one zone which is now depleted and it is desired to recomplete this well in a different zone by the use of this invention. In such cases, the large perforations necessary to this invention can be achieved by conventional means.

Although the invention has been described in its preferred forms with a certain degree of particularity, it is understood that the present disclosure is only by way of example and that numerous changes in the combination and arrangement of parts may be resorted to without departing from the spirit and scope of the invention as hereinafter claimed.

I claim:

1. A method of completing a well in a productive subterranean formation comprising drilling a bore hole into the earth and penetrating the formation;

running into the bore hole a casing string;

cementing the casing string in the bore hole by pumping cement downwardly through the casing string, allowing the cement to pass upwardly through an annulus provided between the casing and the bore hole and allowing the cement to set up;

at least partially filling the hole with a completion liquid;

opening perforations, through the casing string, aggregating a predetermined area;

running into the casing string a gas generating tool comprising a solid propellant charge of a size so that there is at least 14 square inches of open perforation area per cubic foot of propellant;

igniting the propellant charge; and fracturing the formation by delivering the gaseous products produced through the perforations into the formation.

2. The method of claim 1 wherein the opening step comprises opening perforations over a predetermined distance and the running step comprises running into the casing string a gas generating tool comprising a solid propellant charge of a size not smaller than 25% of the interior capacity of the casing string for the predetermined distance.

3. The method of claim 2 wherein the running step comprises running into the casing string a gas generating tool capable of delivering at least about 1,000,000 foot pounds of energy per linear foot of the predetermined distance.

4. The method of claim 2 wherein the running step comprises running into a casing string a gas generating tool comprising a solid propellant charge of a size not smaller than 40% of the interior capacity of the casing string over the predetermined distance and of a size so that there is at least 50 square inches of open perforation area per cubic foot of propellant.

5. The method of claim 2 wherein the running step comprises running a casing string into the well having incipient perforations therein comprising openings in the casing string and a sleeve in the casing string closing the openings and the opening step comprises removing the sleeve.

6. The method of claim 2 wherein the running step comprises running a casing string into the well having incipient perforations therein comprising openings in the casing string and a plug in each of the openings, the opening step comprises removing the plugs.

7. The method of claim 6 wherein the opening step comprises passing a bit into the casing string of sufficient size to engage the plugs and then drilling the plugs with the bit.

8. The method of claim 6 wherein the plugs are made of acid soluble material and the casing string is made of substantially acid insoluble material and the opening step comprises dissolving the plugs with acid.

9. The method of claim 6 wherein the casing string comprises joints of tubular pipe having a longitudinal axis providing threaded openings through the casing string transverse to the longitudinal axis, further comprising the step of threading the plugs into the openings prior to running the casing string into the bore hole.

10. The method of claim 2 wherein the casing string comprises joints of tubular pipe having a generally constant wall thickness through at least a portion of the length of the joint, the casing string having incipient perforations therein comprising areas of substantially decreased wall thickness in the portion of the joint and the opening step comprises concurrently bursting the pipe in the areas of substantially decreased wall thickness and fracturing the formation.

11. The method of claim 2 wherein the running step comprises running a casing string into the bore hole having incipient perforations therein comprising dimples projecting into the interior of the casing string.

12. The method of claim 2 wherein the opening and fracturing steps are conducted concurrently.

13. A method of completing a well in a productive subterranean formation comprising drilling a bore hole into the earth and penetrating the formation;

running into the bore hole a casing string;

opening perforations, through the casing string, aggregating a predetermined area;

at least partially filling the casing string with a completion liquid;

running into the casing string a gas generating tool comprising a solid propellant charge of a size not greater than one cubic foot per 14 square inches of perforation area; and igniting the propellant charge, releasing high pressure gaseous combustion products inside the casing string, passing the high pressure products through the perforation area into the formation for fracturing the same.

14. The method of claim 13 wherein the opening step comprises opening perforations over a predetermined distance and the second running step comprises running into the casing string a gas generating tool comprising a solid propellant charge of a size not smaller 25% of the internal capacity of the casing string for the predetermined distance.

15. The method of claim 14 wherein the second running step comprises running into the casing string a gas generating tool capable of delivering at least 1,000,000 foot pounds of energy per linear foot of the predetermined distance.

16. A method of completing a well in a productive subterranean formation comprising drilling a bore hole into the earth and penetrating the formation;

running into the bore hole a casing string having sensible incipient perforations therein;

cementing the casing string in the bore hole by pumping cement downwardly through the casing string, allowing the cement to pass upwardly through an annulus between the casing string and the bore hole and allowing the cement to set up;

releasing high pressure gas inside the casing string at an energy level at least on the order of about 1,000,000 foot pounds per linear foot of the incipient perforations;

concurrently opening the incipient perforations, creating fluid passages in the cement in the annulus by fracturing the cement and creating fractures in the subterranean formation.

17. The method of claim 16 wherein the incipient perforations are of a predetermined length, the releasing step comprises igniting a solid propellant charge inside the casing string adjacent the incipient perforations of a size not greater than one cubic foot of solid propellant per 14 square inches of the incipient perforations and not smaller than 25% of the interior capacity of the casing string for the predetermined distance.

18. The method of claim 17 wherein the incipient perforations are of a predetermined length, the releasing step comprises igniting a solid propellant charge inside the casing string adjacent the incipient perforations of a size not greater than one cubic foot of solid propellant per 14 square inches of incipient perforations and not smaller than 40% of the interior capacity of the casing string for the predetermined distance.

19. A method of completing a well in a productive subterranean formation through a casing string cemented in a bore hole penetrating the formation and communicating with the formation through perforations comprising a predetermined area, comprising at least partially filling the casing string with a completion liquid;

running into the well a gas generating tool comprising a solid propellant charge of size not greater than one cubic foot per 14 square inches of perforation area; and igniting the propellant charge, releasing high pressure gaseous combustion products inside the casing string, passing the high pressure combustion products through the perforations into the formation and fracturing the same.

20. The method of claim 19 wherein the perforations extend over a predetermined distance and the running step comprises running into the casing string a gas generating tool comprising a solid propellant charge of a size not smaller than 25% of the interior capacity of the casing string for the predetermined distance.

* * * * *